US005358151A

United States Patent [19]

Strasenburgh

[11] Patent Number: 5,358,151

[45] Date of Patent: Oct. 25, 1994

[54] LIQUID DROPPER DISPENSER

[75] Inventor: James A. Strasenburgh, Guaynabo, P.R.

[73] Assignee: Universal Container Corporation, Cayey, P.R.

[21] Appl. No.: 64,557

[22] Filed: May 21, 1993

[51] Int. Cl.[5] ..... B65D 47/18

[52] U.S. Cl. ..... 222/420; 222/556; 215/235; 220/259; 220/335

[58] Field of Search ..... 222/420, 498, 556, 562; 215/235, 237; 220/259, 335, 341, 339

[56] References Cited

U.S. PATENT DOCUMENTS 2,514,576 7/1950 Hein et al. .
2,734,665 2/1956 Flamm .
2,769,583 11/1956 Darlington, Jr. .
2,907,496 10/1959 Carstensen .
3,788,528 1/1974 Ogle .
4,010,875 3/1977 Babiol .
4,234,103 11/1980 Strobl, Jr. et al. .
4,408,699 10/1983 Stock .
4,413,753 11/1983 Stock .
4,471,890 9/1984 Dougherty .
4,498,609 2/1985 Stock .
4,699,283 10/1987 Dubach .
4,711,363 12/1987 Marino .
4,759,455 7/1988 Wilson .
4,807,768 2/1989 Gach .
4,880,146 11/1989 Hudgins .
4,911,324 3/1990 Dubach .
4,940,167 7/1990 Fillmore et al. .
5,067,624 11/1991 Thanisch ..... 222/498 X
5,076,474 12/1991 Hansen .
5,143,234 9/1992 Lohrman et al. .

*Primary Examiner*—Gregory L. Huson
*Attorney, Agent, or Firm*—Banner, Birch, McKie & Beckett

[57] ABSTRACT

A one-piece dispenser cap adapted for the controlled dispensing of liquids in droplet form is particularly configured to enable the use of a living hinge and closure cover combination that is of convenient size to reduce the complexity and cost of construction of the device. The described cap construction includes a funnel surface for directing fluid for discharge whereby dispensing of substantially all of the fluid from the container is insured. Appropriate sealing structure prevents contamination of the contained liquid and use of the living hinge uncomplicatedly prevents interference by the closure cover with liquid as it is dispensed.

29 Claims, 3 Drawing Sheets

LIQUID DROPPER DISPENSER

BACKGROUND OF THE INVENTION

The present invention relates to liquid dropper dispensers. More particularly, the invention involves an integrated container cap having a drop dispensing nozzle and a pivotably attached cover for releasably closing the nozzle tip.

Dropper nozzles may be used, inter alia, to dispense precise amounts of liquid products, such as diagnostic reagents, adhesive, ophthalmic solutions and other liquid chemicals. Conventionally, the dispensing of liquid drops from a container, such as a bottle, is effected by inserting a dropper nozzle, or spindle, into the internal diameter of the neck of the bottle and securing a cap thereto in a manner as to operatively fix the spindle to the bottle. Such nozzles are normally closed by separate covers and the covers and the nozzles can, respectively, be snap fit or friction fit elements.

Numerous liquid dispensing devices are known in the prior art. For example, U.S. Pat. Nos. 4,010,875 and 4,807,768, among others, indicate that it is not new to construct liquid dispensing caps having an integrally formed closure cover and U.S. Pat. No. 2,514,576 indicates that it is old to provide the spindle body of a dispensing nozzle with a funnel-shaped surface about the inlet opening of the spindle passage for directing liquid thereto.

The principal problem that is particularly addressed by the present invention, however, is the need to incorporate into a wholly integrated cap and closure cover for liquid dispenser bottles the ability to accurately and repeatedly dispense controlled amounts of liquid as precisely sized droplets until the liquid is completely dispensed from the bottle. The concerned cap must be inexpensive to construct and easy to operate. It must further be designed to prevent both liquid leakage from the cap and container as well as the ingress of contaminants into the container.

It is to the achievement of these ends therefore, to which the present invention is directed.

SUMMARY OF THE INVENTION

Accordingly, there is provided by the present invention a cap for attachment to a liquid container for the dispensing of liquid therefrom comprising a base formed generally as a hollow cylinder; a partition extending transversely of the axis of the base intermediate the ends thereof; a spindle upstanding from the upper surface of the partition; a nozzle passage extending axially through the spindle being open at the inlet and outlet ends thereof for discharge therethrough of liquid from the container; a cover for closing the tip of the spindle; and a hinge integrally connected between the cover and the base for pivotal movement of said cover between a closed position on the spindle tip and an open position angularly displaced therefrom.

The cap according to the invention desirably employs a living-type hinge for connecting the closure cover to the cap base in order to insure that the cover, when opened, is firmly retained in a position remote from spindle tip, so as to prevent interference from the cover with the dispensing of liquid.

Moreover, in order to accommodate a closure cover and living hinge of manageable proportions without the need for the utilization of expensive ancillary structure, the spindle is supported on a transverse partition disposed at an intermediate axial position within the cap base whereby the spindle is disposed in a recess therewithin with its tip projecting only so far above the upper rim thereof as to permit the accurate placement of dispensed droplets.

To effectively seal and secure the closure cover with respect to the spindle tip, the cover is provided with a domed cavity for enclosing the tip and a radial flange for engagement with the cap upper rim. The dome of the cover and the spindle tip are provided with an annular rib and a complementary cooperating recess, respectively, to sealedly and fixedly secure one element to the other.

The partition that supports the nozzle spindle is advantageously formed on its underside with a conical surface forming a funnel having a shallow taper, at the apex of which the inlet to the liquid dispensing passage communicates.

In order to effectively seal the interface between the cap and the mouth of the container, the cap and container are provided with cooperating threads and a flexible annular sealing skirt depending from the underside of the transverse partition to sealedly engage the container mouth when the cap is threadedly secured to the container.

For a better understanding of the invention, its operating advantages and the specific objectives obtained by its use, reference should be made to the accompanying drawings and description which relate to a preferred embodiment thereof.

DETAILED DESCRIPTION THE PREFERRED EMBODIMENTS

Figure 1:
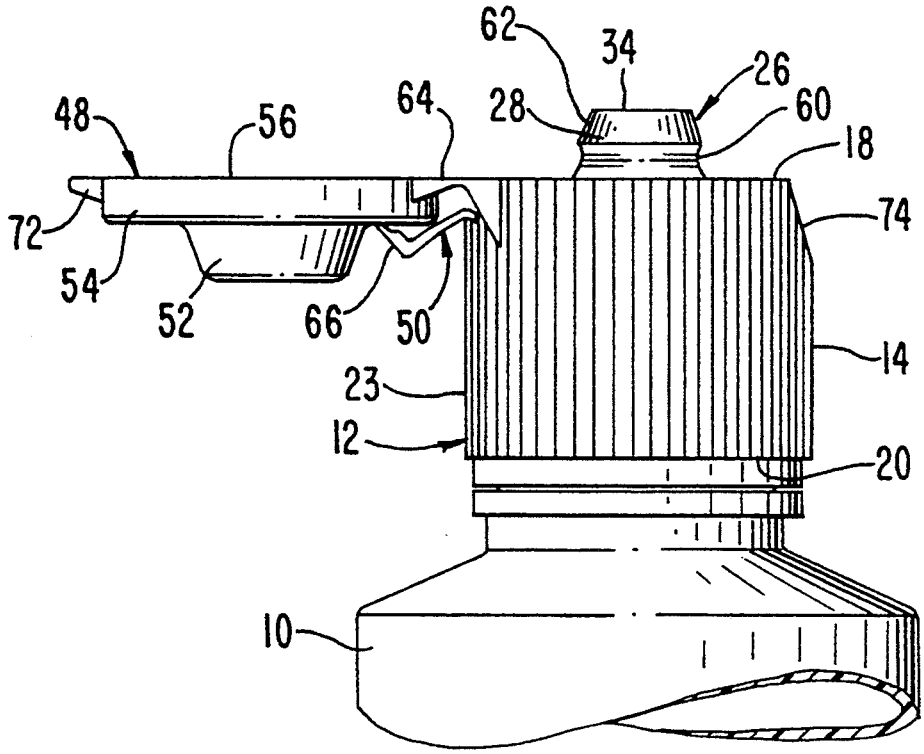
FIG. 1 is a partial elevational front view of a liquid container, such as a bottle, provided with a cap according to the invention.
Figure 2:
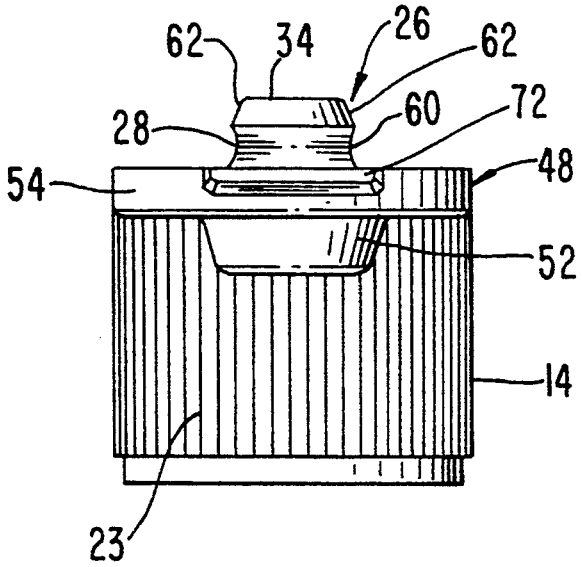
FIG. 2 is a side view of the cap of FIG. 1.

Referring now to the drawings, there is shown in FIG. 1 a liquid container 10 in the form of a plastic bottle, or the like, to the mouth of which is attached a cap 12 constructed according to the invention. The cap 12 is advantageously formed of molded plastic, such as polypropylene. It includes a base 14 defined by a body that is, generally, a hollow fight circular cylinder having a partition 16 extending transversely of the axis of the body intermediate the upper and lower ends thereof that are identified as rims 18 and 20, respectively.

The interior wall of the body forming base 14, in the region extending below the partition 16, contains threads 22 for connection with cooperating threads (not shown) on the neck of the container 10. Circumferentially spaced vertical ribs 23 about the external surface of the base body facilitate manual connections of the cap to the bottle. The upper surface 24 of the partition 16 supports the liquid dispensing nozzle, indicated generally as 26, disposed in concentrically spaced relation to that part of the interior wall of the base which extends above the partition upper surface 24. Nozzle 26 includes a centrally disposed upstanding, generally cylindrical spindle 28 whose lower end 30 is integral with the partition 16 and whose upper end 32 projects beyond the upper rim 18 of the base 14 terminating in a tip 34.

A passage 36 for the controlled flow of liquid from the container 10 extends axially through the spindle 28. Passage 36 includes an inlet opening 38 formed as a flow-restricting orifice and communicating with the space beneath the partition 16. The orifice defining inlet opening 38 is formed of a predetermined diameter to control the rate of liquid flow through the passage 36. The upper end of the passage 36 adjacent the tip 34 is formed as an outwardly flared outlet opening 40 whose diameter is of predetermined size to control the diameter of the liquid drops discharged from the dispenser. Intermediate the inlet and outlet openings 38 and 40, respectively, the passage 36 contains cylindrical and conical transition portions 42 and 44, respectively.

A dispenser of the "controlled flow" type will have an orifice at the inlet opening 38 that is typically no greater than about 0.012 inches. For example, with a 0.012 inch diameter orifice at the inlet opening 38 and a 0.180 inch diameter at the outlet opening 40 such dispenser will produce about fifteen drops per milliliter of liquid.

In order to facilitate molding of the small diameter orifice forming the inlet opening 38, the partition 16, as molded, may contain a slight projection 46 depending from its underside. Projection 46 is typically no greater in length than a few thousandths of an inch and results from the support provided for the core pin utilized in molding the orifice.

According to the invention, cap 12 contains a cover 48 adapted to close the tip 34 of the spindle 28 and connected to the base 14 by a "living" hinge 50. The cover 48 contains a centrally disposed dome portion 52 whose interior shape conforms substantially to that of the spindle tip 34. An annular flange portion 54 extends concentrically about the dome portion 52 and is provided with a bearing surface 56 for engagement with the base upper rim 18 when the cover is closed. Disposed about the open end of the interior space in the dome portion 52 is an annular rib 58 that cooperates with a complementary annular recess 60 on the spindle 28 adjacent the tip 34. Desirably, the rib 58 bears a slight interference fit with respect to the spindle tip 34 and is guided into retained relation with the recess 60 via a conical guide surface 62 which extends between the recess and the tip.

The hinge, which is of the "living" type, is identified generally at 50. It includes a pair of oppositely spaced pivot strips 64 that extend between one side of the cover 48 and the cap base 14 closely adjacent the upper rim 18. Intermediate the pivot strips 64 is an L-shaped hinge lever 66 that also extends between and connects with the cover 48 and the cap base 14, connection being effected by means of pivot connections 68 and 70, respectively. By means of this hinge connection the cover 48 is caused to be biased into one of two possible positions depending to which side of a dead-center position of the hinge lever the cover is angularly displaced. Consequently, when the cover 48 is moved outwardly beyond the dead center position of the hinge 50 it will be retained under the influence of the hinge lever 66 in the open position well away from the spindle tip 34. Alternatively, when moved inwardly, the cover 48 assumes a position with the dome portion 52 in engagement with the guiding surface 62 on the spindle tip 34 whereupon the cover can be pressed to cause the annular rib 58 to seat in the recess 60 thereby holding the cover in locked engagement upon the spindle.

In order to facilitate release of the cover 48 from its locked engagement with the spindle 28 the flange portion 54 may be formed with a finger tab 72 positioned diametrically opposite the hinge 50 and projecting from the peripheral edge of the flange. Cooperating with the tab 72 is an inclined recess 74 formed on the external surface of the base and extending upwardly and inwardly to the upper rim 18.

Figure 3:
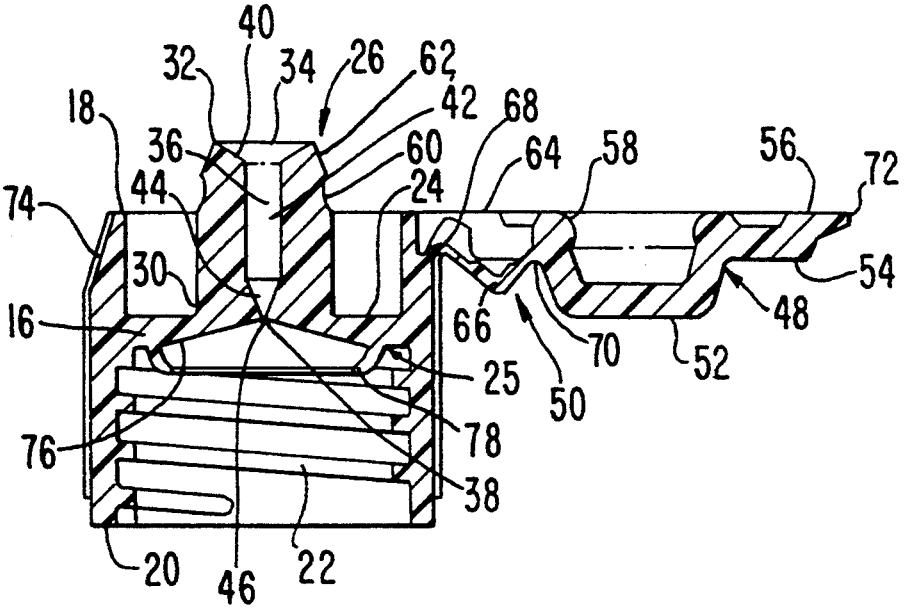
FIG. 3 is a sectional view of the cap of FIG. 1.
Figure 4:
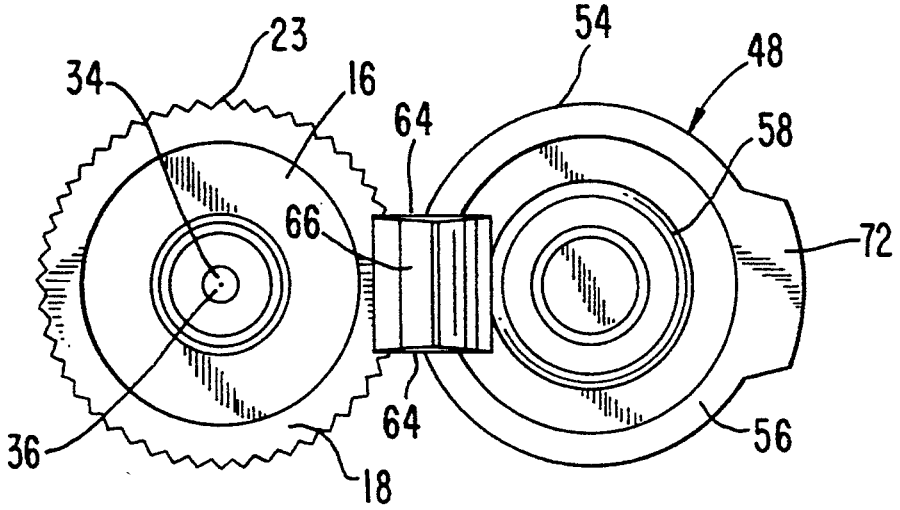
FIG. 4 is a top view of the cover of FIG. 1.

To insure dispensing of substantially all of the liquid from the container bottle 10, the partition underside 25 is formed as a conical surface 76 defining a funnel. As shown in FIG. 3, the inlet opening 38 to the passage 36 is disposed at the apex of the surface 76 whereby, when the bottle 10 is inverted into a dispensing attitude, liquid will be directed toward the opening for admission to the passage and discharge from the tip 34. Desirably, the taper angle of the surface 76, as measured from the horizontal, is kept small in order to provide a funnel of shallow proportions. This angle should be less than about thirty degrees and, more preferably, about fifteen degrees in order to insure dispensing of all but a minimal amount of liquid from the dispenser.

An effective seal is provided between the cap 12 and the mouth of the container 10 in the form of an annular sealing skirt 78 which depends from the underside 25 of the partition 16, spaced concentrically outwardly from the inlet opening 38 to passage 36. The skirt 78 is formed with opposed sides 80 and 82 that are curved and downwardly convergent so as to impart flexibility to the member. At its bottom end the skirt is turned radially inwardly and possesses a diameter thereat to locate the skirt on the rim (not shown) which extends around the mouth of the container 10. Consequently, when the cap 12 is threadedly seated upon the container neck, the skirt 78 is deformedly pressed onto the rim thereof to effectively prevent either leakage of liquid out of the container 10 or ingress of contaminants thereinto.

Figure 5:
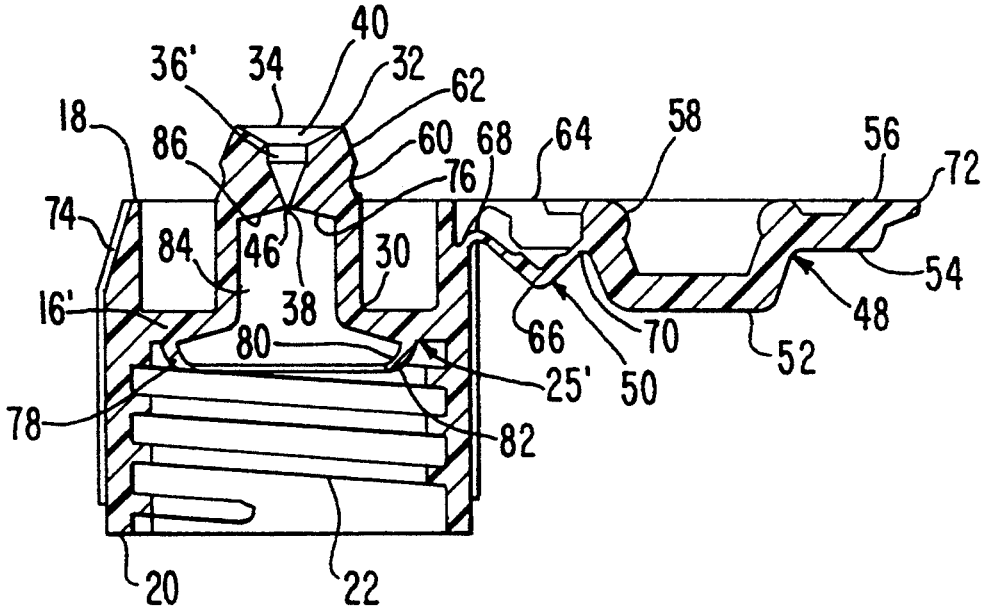
FIG. 5 is a view, similar to FIG. 3, illustrating an alternative embodiment of the invention.

FIG. 5 shows an alternative embodiment of the invention in which the wall of the spindle, indicated as 28', is formed with an elongated cored-out recess 84 that places the inlet opening 38' at an elevated position vertically spaced from the partition 16'. In order to retain the function of a funnel for directing liquid toward the inlet opening 38 the closed end of the recess 84 is provided with a surface 86 having a slight conical taper which is, desirably, about the same angularity as the taper of the surface 76 in the earlier embodiment. Also, the underside 25' of the partition 16', radially within the sealing skirt 78, is formed with a similar annular taper for directing liquid when the dispenser is inverted, into the recess 84 for ultimate discharge from the foreshortened passage 36'.

There has thus been described a one-piece dispenser nozzle and closure that is particularly suitable for use in controlled dropper tip applications in which precise and repetitive drop control is desired. Being formed of one piece, the part can be readily molded entirely of polypropylene material whereby it can be sterilized by the more expensive measures, such as by ethylene dioxide or irradiation, but also by means of the less expensive means, such as autoclave steaming. The one piece construction has the further advantage that closure covers cannot be interchanged thereby eliminating the danger of cross contamination of liquids in diverse containers.

Covers on caps having the described structural configuration can be operated by one hand. Moreover, the cover, when closed upon the spindle, completely seals the dispenser against contamination. When open, the cover is biased to a position remote from the discharge opening in the spindle tip whereby interference with the dispenser discharge is avoided.

It will be understood that various changes in the details, materials and arrangements of parts which have been herein described and illustrated in order to explain the nature of the invention, may be made by those skilled in the art within the principle and scope of the invention as expressed in the appended claims.

I claim:

1. A cap for attachment to a liquid container for the dispensing of liquid therefrom, said cap comprising:

a base formed generally as a hollow cylinder and having a first end opposite a second end;

a partition integrally formed with said base and extending tranversely of the axis of said base between the first and second ends of said base, said partition having an upper surface;

a spindle integrally formed with said partition and said base, extending from the upper surface of said partition to a spindle tip and having a nozzle passage that extends axially through said spindle for discharge of fluid from said liquid container, said nozzle passage having an inlet opening and an outlet opening at the spindle tip, wherein a funnel-shaped surface of said cap is adjacent to said inlet opening;

a cover for closing the spindle tip; and a living hinge for integrally connecting said cover to said base and for providing biased pivotal movement of said cover between a closed position on said spindle tip and an open position angularly displaced therefrom.

2. A cap according to claim 1 including internal threads formed on the cylindrical surface of said base in the region extending from an underside of said partition.

3. A cap according to claim 1 formed entirely of molded polypropylene material.

4. A cap according to claim 1 in which said base contains an annular rim spaced axially from said partition and said hinge is connected to said base adjacent said rim.

5. A cap according to claim 4 in which said spindle projects beyond said rim.

6. A cap according to claim 5 in which said cover includes a dome for enclosing the tip of said spindle and a generally annular flange having a surface extending radially from said dome for seating on said rim.

7. A cap according to claim 6 including means for sealing the interface between said dome and said spindle tip.

8. A cap according to claim 7 in which said interface sealing means comprises an annular recess formed on one of said spindle or said dome and an annular projection formed on the other thereof for cooperative sealing engagement with said recess.

9. A cap according to claim 1 in which said funnel-shaped surface is conically tapered at an angle less than about thirty degrees.

10. A cap according to claim 9 in which said funnel-shaped surface has an angle of taper of about fifteen degrees.

11. A cap according to claim 9 in which said funnel-shaped surface is disposed in said spindle axially displaced from said partition.

12. A cap according to claim 9 in which said funnel-shaped surface defines an underside of said partition.

13. A cap according to claim 12 wherein said funnel-shaped surface is integrally formed with said partition.

14. A cap according to claim 9, said spindle including a recess extending axially from said partition to said inlet opening, said recess having an open end opposite a closed end that is adjacent to said inlet opening, wherein said funnel-shaped surface is formed on said closed end.

15. A cap according to claim 14 wherein said funnel-shaped surface is integrally formed with said spindle.

16. A cap for attachment to a liquid container for the dispensing of liquid therefrom, said cap comprising:

a base formed generally as a hollow cylinder having upper and lower annular rims;

a partition integrally formed with said base and extending tranversely of the axis of said base between the upper and lower annular rims of the base, said partition having an upper surface;

a spindle integrally formed with said partition and said base, extending from the upper surface of said partition, projecting beyond said upper rim of said base to a spindle tip and having a nozzle passage that extends axially through said spindle and that is configured to control discharge of fluid from said liquid container in precise amounts and drop size, said nozzle passage having an inlet opening and an outlet opening at the spindle tip, wherein a funnel-shaped surface of said cap is adjacent to said inlet opening;

a cover for closing the spindle tip; and a living hinge for integrally connecting said cover to said base and for providing biased pivotal movement of said cover between a closed position on said spindle tip and an open position angularly displaced therefrom.

17. A cap according to claim 16 in which said funnel-shaped surface contains a conical taper of less than about thirty degrees.

18. A cap according to claim 17 in which said funnel-shaped surface has an angle of taper of about fifteen degrees.

19. A cap according to claim 17 in which said cover includes a dome for enclosing the spindle tip and a generally annular flange extending radially from said dome for seating on said rim.

20. A cap according to claim 19 including a recess formed on the exterior of said base for exposing a portion of said annular flange to facilitate release of said cover from said spindle tip.

21. A cap according to claim 20 in which said recess is defined by an inclined surface extending to said upper rim of said base.

22. A cap according to claim 21 formed entirely of molded polypropylene material.

23. A cap according to claim 16 in which said funnel-shaped surface is conically tapered at an angle less than about 30 degrees.

24. A cap according to claim 23 in which said funnel-shaped surface has an angle of taper of about fifteen degrees.

25. A cap according to claim 23 in which said funnel-shaped surface defines an underside of said partition.

26. A cap according to claim 25 wherein said funnel-shaped surface is integrally formed with said partition.

27. A cap according to claim 23 in which said funnel-shaped surface is disposed in said spindle axially displaced from said partition.

28. A cap according to claim 23, said spindle including a recess extending axially from said partition to said inlet opening, said recess having an open end opposite a closed end that is adjacent to said inlet opening, wherein said funnel-shaped surface is formed on said closed end.

29. A cap according to claim 28 wherein said funnel-shaped surface is integrally formed with said spindle.

* * * * *